United States Patent [19]

Crespo

[11] Patent Number: 4,514,949

[45] Date of Patent: May 7, 1985

[54] INTERLOCKING SYSTEM FOR BUILDING WALLS

[76] Inventor: Jorge L. N. Crespo, 809 Managua St., San Juan, P.R. 00921

[21] Appl. No.: 492,132

[22] Filed: May 6, 1983

[51] Int. Cl.[3] ..... E04C 1/10

[52] U.S. Cl. ..... 52/585; 52/603; 52/607; 52/293

[58] Field of Search ..... 52/603, 606, 607, 585, 52/747

[56] References Cited

U.S. PATENT DOCUMENTS

| | | | |
|---|---|---|---|
| 711,541 | 10/1902 | Standau | 52/603 X |
| 2,257,001 | 9/1941 | Davis | 52/593 X |
| 2,911,818 | 11/1959 | Smith | 52/606 X |
| 3,390,502 | 7/1968 | Carroll | 52/585 X |
| 4,018,018 | 4/1977 | Kosuge | 52/607 X |
| 4,228,628 | 10/1980 | Schloman | 52/585 X |

*Primary Examiner*—Carl D. Friedman

[57] ABSTRACT

A wall comprising superposed rows of aligned conventional building blocks having approximately parallel front and back faces connected by a plurality of transverse webs defining chambers therebetween is disclosed in which the tops and bottoms of the blocks are formed to include uniformly spaced apart ball-receiving depressions positioned so that the depressions in the tops of each block mate with the depressions in the bottoms of the block above it. Balls are fitted into the space defined by the mating depressions, these being slightly larger than the mating depressions to space the blocks, and the depressions in the tops of each block are machined to a specific limit in relation to the height of the block so that the interconnection of the blocks by the balls aligns the blocks. Also, the upper face of the webs is formed with longitudinally aligned V-shaped grooves positioned at a uniform distance from the front faces of the blocks, and elongated straight bars are fitted in the grooves to align the blocks in each row.

9 Claims, 13 Drawing Figures

INTERLOCKING SYSTEM FOR BUILDING WALLS

Figure 1:
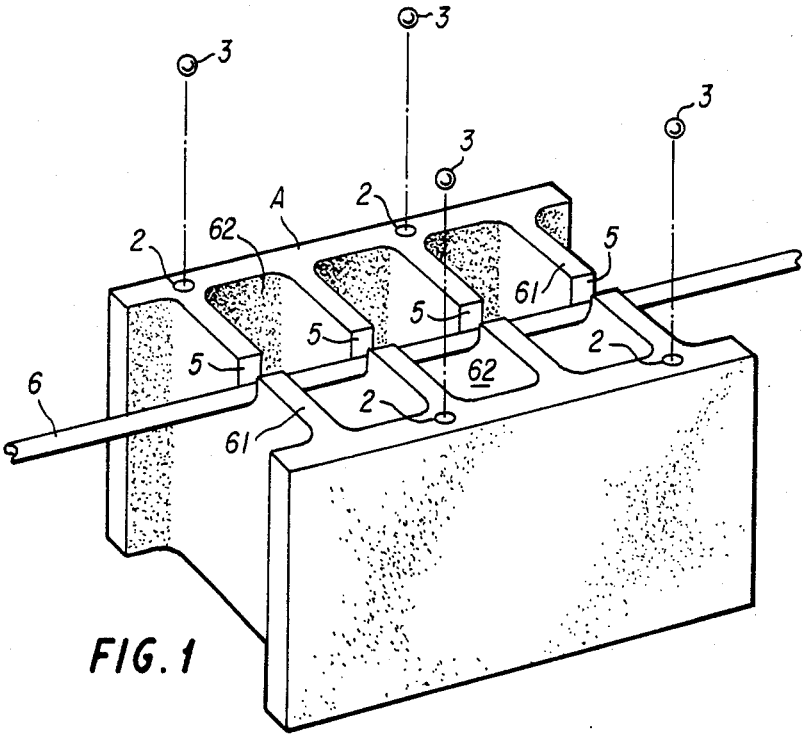

This invention relates to building a wall and its foundation with conventional building blocks incorporating a system for aligning said blocks into a vertically and horizontally straight wall.

The conventional concrete block has been recognized as the least expensive construction material, at less than one cent per pound. Furthermore, the concrete block has also been recognized as the most versatile construction material for being firesafe, sound deadening and absorbing, and decorative, and for being readily available all over the world, being virtually maintenance free and indestructible, and being termite safe and almost tenant safe. Today, it is possible to produce 25,000 concrete blocks every 8 hours with the new machines in the market place. So far, production is highly mechanized and economically productive. Nevertheless, the installation methods have remained the same for many, many years dependent upon installation by highly skilled labor. Attempts have been made to mechanize the installation by using cheap unskilled labor. One such attempt is the use of odd shaped interfitting blocks but this system shoots the cost of the per square foot of wall above the $3.00 level. Another attempt is shown in the Schlomann U.S. Pat. No. 4,228,628 which shows the use of spherical metal balls situated in aligned hemispherical openings between two superposed blocks. However, this system of alignment has not been commercially viable for use because not only are the balls ill-fitted but also there is no means present to assure alignment of the balls in their grooves to compensate for variation in height of the blocks and for variations in perpendicularity of the faces.

Even the new block-producing machines cannot make the blocks accurate to less than 0.050 of an inch in height. Because of this, the accepted tolerance in block height is plus or minus 1/16 of an inch. Consequently, this variation in height in extreme instances can be up to $\frac{1}{8}$ of an inch. Some means must be provided to compensate for this variation in height.

Therefore, the main object of this invention is to employ means to overcome this variation in height of the blocks.

Another object of this invention is to compensate for the variations in face perpendicularity of the blocks.

A further object of the invention is to provide a means for an unskilled worker to allow him to construct an accurately positioned and levelled first row of building blocks.

A further object of this invention is to locate the metal balls 7.875 cm. apart to make sure of sufficient holding power in connecting the superposed blocks and to obtain an accurate lengthwise spacing of 15.750 inches (40 cm.) between blocks.

Figure 2:
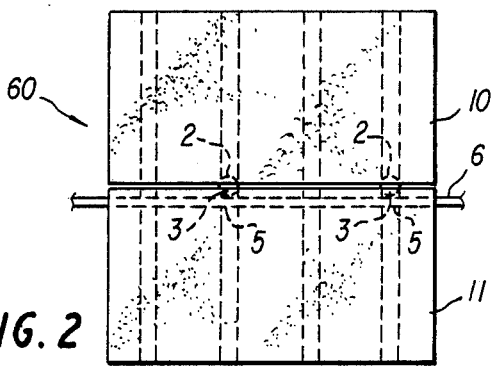
Figure 3:
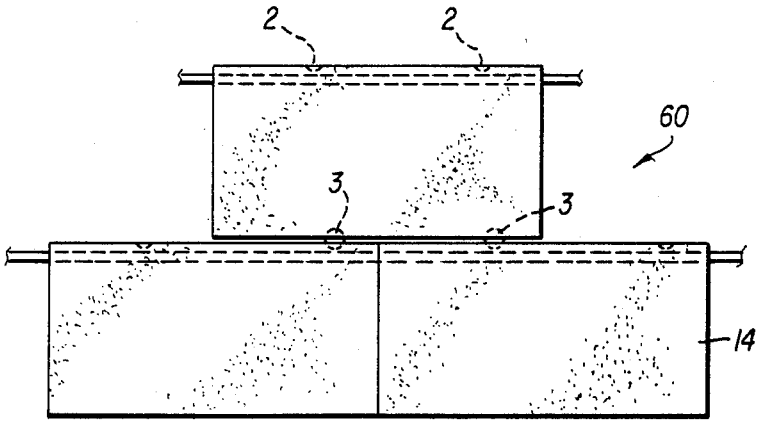
Figure 4:
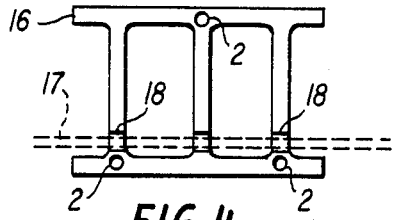
Figure 5:
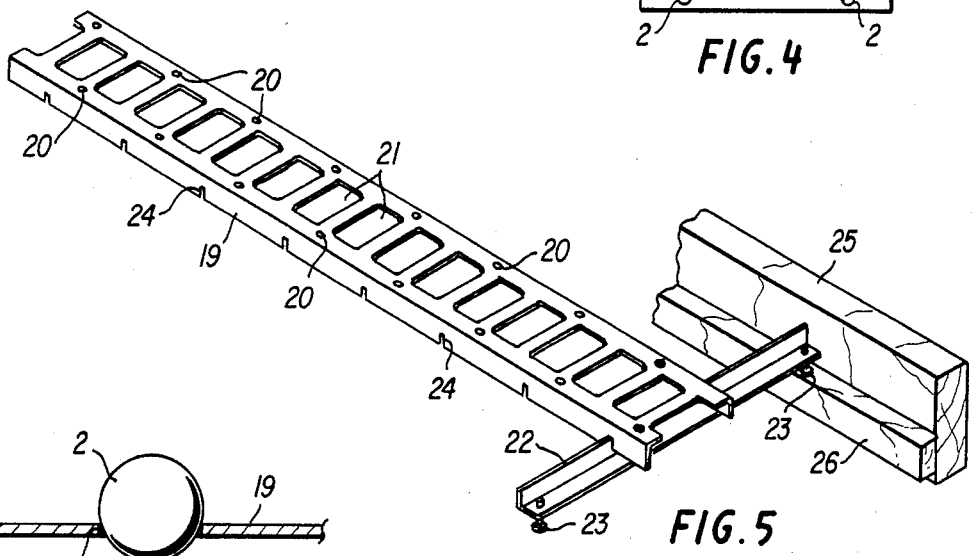
Figure 5A:
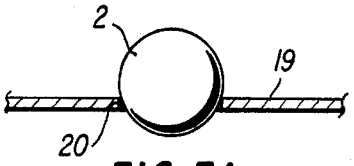
Figure 6:
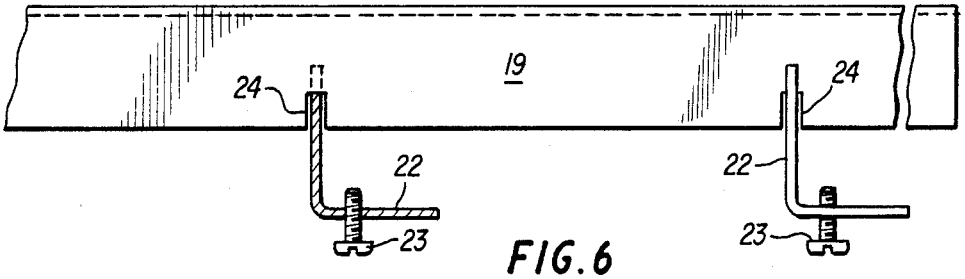
Figure 7:
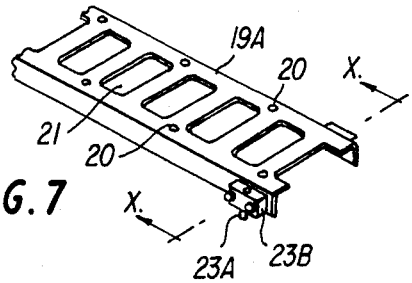
Figure 8:
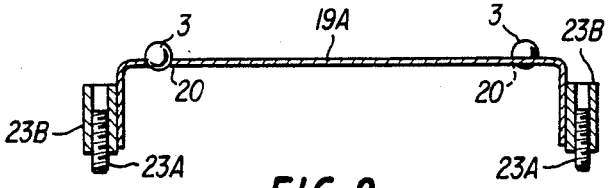
Figure 9:
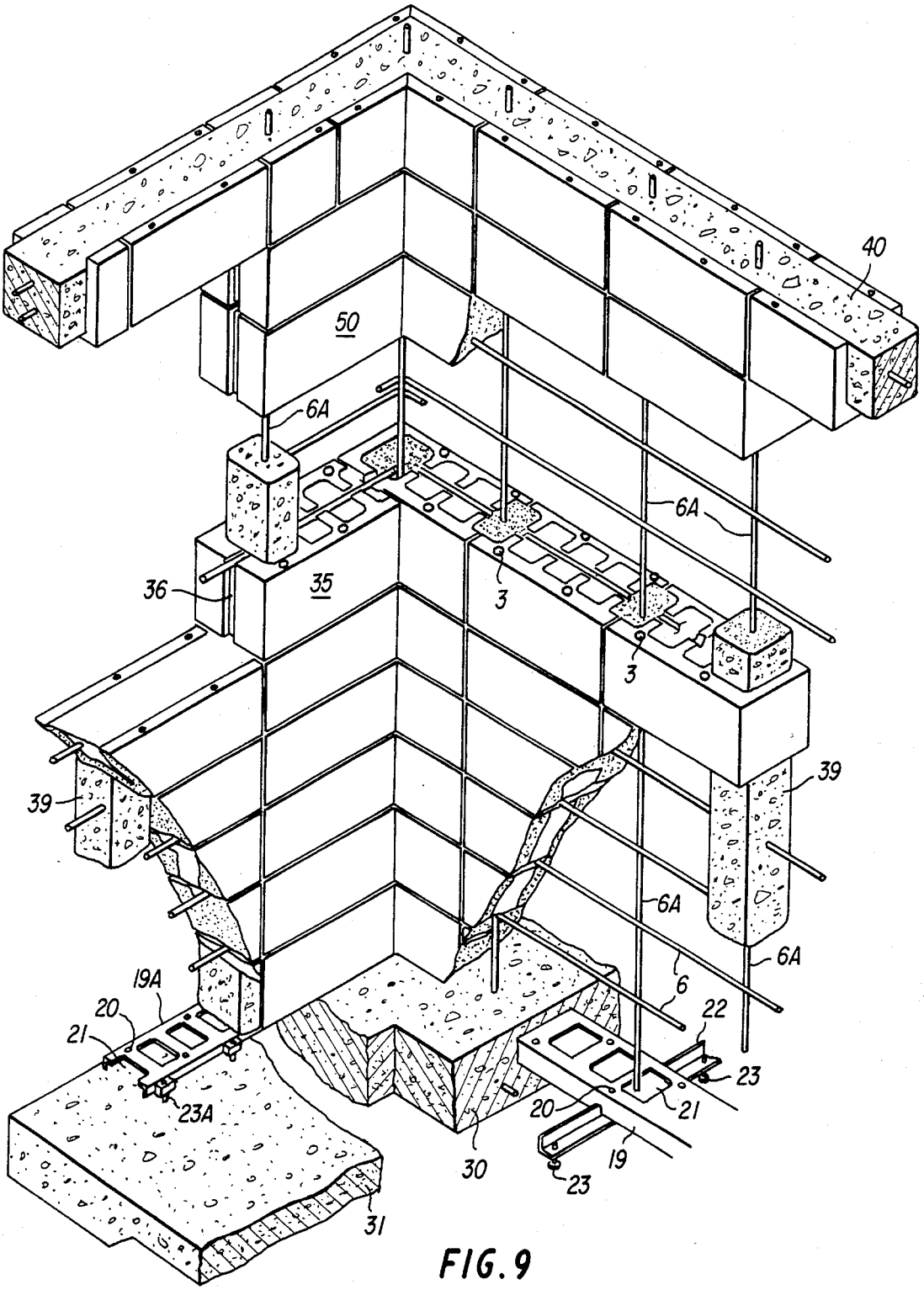
Figure 10:
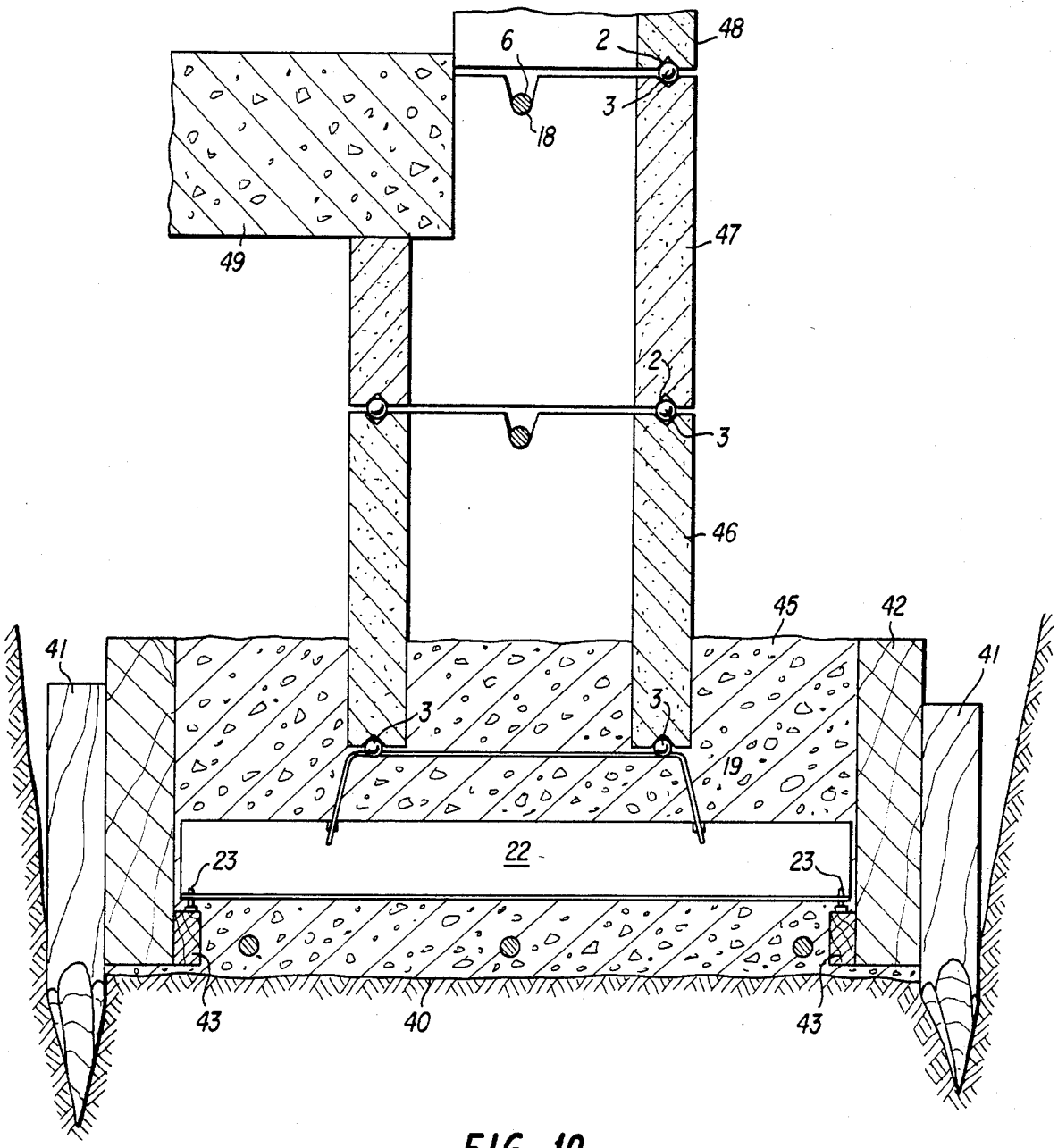
Figure 11:
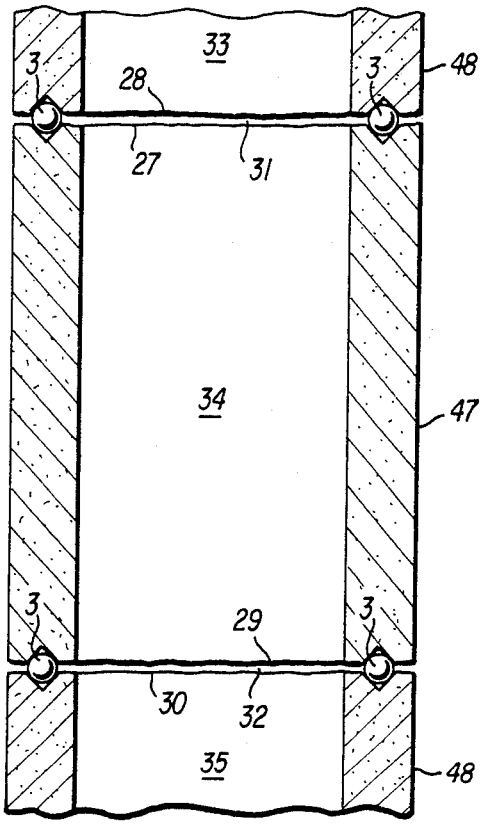
Figure 12:
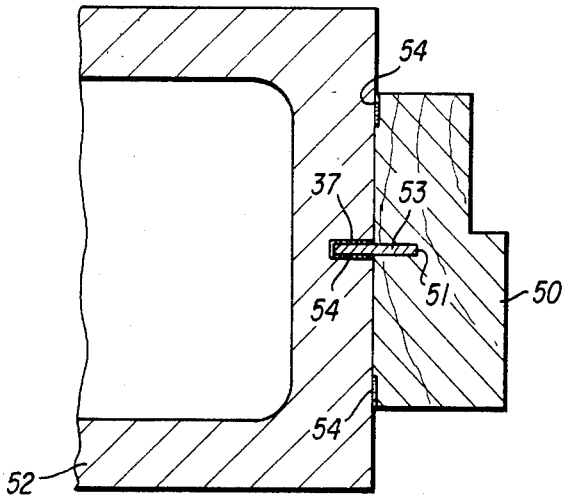

With the foregoing objects in view together with such other objects and advantages as may subsequently appear, this invention resides in the parts and in combination, construction and arrangements of parts hereinafter described and claimed and illustrated by way of example in the accompanying drawings in which:

FIG. 1 is a perspective view of a 3-chamber building block, with the inclusion of a medially positioned rod and an exploded section view of the V-groove, FIG. 2 is a front elevation view of a cross-section of 2 superposed building blocks in alignment, FIG. 3 is a front elevation view of a cross-section of 3 building blocks in broken joint relation to each other, FIG. 4 is a top cross-sectional view of a 2-chamber block with an offset rod nearer the front face of the block, FIG. 5 is a perspective view of a leveling means, FIG. 5*a* is an exploded cross-section of a ball and the channel opening for the ball, FIG. 6 is an amplified cross-section view of a sheet metal angle with its leveling screws, FIG. 7 is a perspective view of a modified leveling channel for floor or roof slab use, FIG. 8 is a cross-section of FIG. 7 showing the use of metal bands and leveling screws, FIG. 9 is a perspective view of 2 reinforced masonry wall sections showing a window and a door opening and an exploded view of the leveling plates, FIG. 10 is a cross-section view showing a wall footing from ground to floor slab, FIG. 11 is a cross-sectional view of 3 superposed blocks to show the relative positioning and clearances between the openings and the balls, and FIG. 12 is a cross-sectional view showing the interconnection for a door frame and building end block.

Referring to the drawings, in FIG. 1 there is shown a 3-chamber building block which has been machined to compensate for variations in height of the block so as to provide a tolerance of 0.002 of an inch between opposed edges of the openings. The block bottom and top faces are irregular and coarse. In addition, the side and bottom or top faces vary in perpendicularity to each other. The openings are machined into the top and bottom faces at the same time. These openings are machined in relation to the plane passing through the lowest contact point of the block with its opening bottoms lying in a plane that is accurately perpendicular to the block side planes. The depth of these top openings are machined to a specific limit in relation to the height of the block. Thus, when conventional blocks measuring 6 in.×8 in.×16 in. are to be used, these blocks are actually $5\frac{5}{8}$ inches wide, $7\frac{5}{8}$ inches long, but vary from $7\frac{3}{4}$ inches to $7\frac{5}{8}$ inches in height. In using $\frac{3}{8}$ in. spherical metal balls, these openings are accurately machined, to be within 0.002 of an inch tolerance, thus the superposed blocks will be perpendicular and parallel to each other. Such accuracy is attainable when measured between planes passing through the center of the balls. These machined openings are made in the building blocks with such accuracy as to obtain a tolerance less than 0.010 of an inch for 10 foot lengths and heights. It is noted that the depth of the drilled opening is dependent upon the specific height of the block.

In FIG. 1, the metal ball 3, having a $\frac{3}{8}$ inch diameter, is placed in the specifically machined opening 2 while metal rod 3 is deposited in machined V-groove 5. Such a rod is utilized to assure means for adjusting the misalignment of superposed blocks due to particles of dust, sand or stone accidentally dropped into the openings and which particles are then crushed against the ball so the block falls into its proper place. The balls may be composed of steel bearings or resinates. The lengthwise distance between adjoining balls equals $\frac{1}{2}$ the modular length of the blocks and the crosswise distance between the lines of adjoining balls is 1.180 inches smaller than the block width. These tolerances are critical and the result of numerous trial and error experimenting to determine such optimum tolerances. FIG. 2 shows 2 superposed blocks 10 and 11 with machined depth opening 2 in which are located balls 3. FIG. 3 shows 2 lower blocks 12 and 14 that are superposed in staggered arrangement, block 15 showing specifically machined openings 2 in which balls 3 are placed. Usually 4 staggered openings are used for a 3-chamber block but, if larger, the numer would increase, if smaller, it would decrease. To assure against misalignment of the balls in their machined openings, a standard length of reinforcing steel rod 6 is manipulated so that the machined openings will fit snugly on the top half of the balls. The advantage of using a steel rod to adjust for misalignment is that such a rod being composed of metal can also serve as a reinforcement means. In many instances, when using chambered building blocks, it is desirable to keep the chambers free for later insertion of wires and pipes. In FIG. 4, there is shown a 2-chamber building block in which a machined V-groove is offset close to the face of the block.

The kind of balls that can be used include commercially available steel ball bearings, hollow or solid, and stress-bearing resinates.

The building blocks can be 2- or 3-chamber and can be of any size or shape such as lintel blocks, building blocks or blocks made of bricks, glass, resin or cellulosic composition.

When machining the hemispherical openings, opposed conical drills are so located as to provide all the openings needed on each block at one drilling time which provides openings that result in a maximum tolerance of 0.002 inches both in depth and the spacing between the opening edges. These openings should be 7.875 inches apart.

As will now be evident, this invention provides a wall 60 composed of superposed rows of longitudinally aligned building blocks having approximately parallel front and back faces connected by a plurality of transverse webs 61 which define chambers 62 between the webs. The top and bottom of these front and back faces are approximately parallel and provide longitudinally extending tops and bottoms for the blocks. The tops and bottoms are formed to include uniformly spaced apart ball-receiving depressions 2 positioned so that the depressions in the tops of each block mate with the depressions in the bottoms of the block above it. Balls 3 are fitted into the space defined by the mating depressions, these balls, as shown, are slightly larger than the mating depressions to space the blocks. The depressions in the tops of each block are machined to a specific limit in relation to the height of the block so that the interconnection of the blocks by the balls provides horizontal alignment for each ball-supported block. The upper face of the webs is formed with longitudinally aligned V-shaped grooves 5 which are accurately positioned at a uniform distance from the front faces of the blocks, and elongated straight bars of circular cross-section are fitted in the grooves to extend longitudinally and horizontally from one block to the next. When these bars are manipulated in contact with the sides of the V-shaped grooves, the blocks are longitudinally aligned in each row, and the balls will fit snugly in the depressions, as shown.

In FIG. 5, there is shown a leveling means comprising a steel channel 19 with one of several steel angles 22 used to support the channel and the first row of blocks of the wall and the wall footing 25 and 26 to be erected. There are punched openings 21 in the channel to match block cores and punched openings 20 for insertion of balls and punched grooves 24 (0.065 of an inch$\times\frac{1}{2}$ inch) to serve as attachment means for the steel angles 22. FIG. 5*a* illustrates the close tolerance between the opening 20 and the ball 2 with the opening being 11/32 inches and the ball $\frac{5}{8}$ inches. Two steel angles, as shown in FIG. 6, are connected to the sheet metal channel for each block. By adjustment of leveling screws 23 at the steel angles, each first row block when placed on this leveling channel is leveled both crosswise and lengthwise.

In FIG. 6, there is a clear showing of the channel 19 with locked in steel angles 22 and the relation of the blocks supported by said channel.

In FIG. 7, there is shown a variation of the metal channel leveler adapted for use over a floor or a roof slab. This channel member 19A has shorter depending sides having a narrow ledge 23B through which a plate 23C is attached by means of machine screws 23A which being threaded can be used for leveling means.

In FIG. 8, the metal channel 19A which is a cross-section taken of FIG. 3 to clearly show one block in width and shows bead 2 in opening 20 with 2 opposed leveling screws. For each block 4 leveling screws will be used.

In FIG. 9, there is shown 2 adjoining reinforced masonry wall sections which uses this system of building. The wall at the left shows partially built walls over an existing floating slab 31 using standard 3 core blocks 35 and channel 19. The wall at the right and its adjoining section of the left wall are built at the same time that footing 30 is built, using standard 3 core blocks and end block 35 which is provided with groove 36 measuring 1/9 inch$\times\frac{1}{2}$ inch for insertion of window and door frames having side males. There are also leveling channels 19, steel angle 22, leveling screws 23 and reinforcing alignment faces 6 with standard lintel blocks 40 and reinforced concrete columns 39. Side male window frames and door frames can be slid into the female grooves 36. In the exploded section, there is shown steel channel 19, angle iron 22 and leveling screws 23 and misalignment means rods 6 also serving as reenforcement. Any ordinary unskilled worker can with this disclosed system produce the structure of FIG. 9 which provides a load bearing wall capable of supporting more than 4000 lbs. per lineal foot when using standard 6 inch blocks filled at the end cores with reinforced concrete 39. The rods 6 and 6A are $\frac{3}{8}$ of an inch in circumference and when completed, the structure yields 4000 lbs. per lineal foot of wall loads. These loads are fully supported by columns 39, with the perfectly aligned balls 2, and the reinforced columns which are spaced 15.750 inches (40 cms.) apart are kept to a minimal slenderness ratio yet increasing its load bearing characteristic of the column to a maximum. The resultant wall is so closely aligned that its faces can be coated with a thin layer 50 of an aqueous mixture of coarse sand, pea gravel and cement with a higher than normal water ratio to provide for the best chemical setting, since the porous characteristic of the blocks will absorb the excess of water and later will yield the additional water required in the final setting of the concrete. This thin coating may be applied with a brush by unskilled labor to the final texture and color desired at a fraction of the cost of mortar or gypsum plastering by highly skilled labor.

Leaving the 3 cores of the building blocks open by offsetting the misalignment bar provides space for the location of electric, plumbing, refrigeration, and air conditioning and tubing making it easy to open the block cores on either side of the wall. This is very important considering the present and future developments in heating and air conditioning. Underground construction, which has about a 75° Fahrenheit temperature, will now have access to the core blocks for the multiple tubing needed.

Based on the social and economical advantages of this system, the College of Agriculture and Mechanic Arts of the University of Puerto Rico has endeavered in the investigation and testing of this complete system with very favorable results, has constructed 23 wall specimens for ultimate tests for seismic, wind, and hurricane loads at a cost of thousands of dollars.

In FIG. 10, there is shown a cross-section view of 3 superposed blocks comprising a wall footing from ground 40, where stakes 41 are driven into the ground, form board 42 nailed to the stake 41 and support board 43 nailed to the form board 42. Resting on this support board is channel member 22 having channel leveler 19. Set screws 23 are used to level said channel member. Balls 3 are placed in openings 2 for superposing blocks 46, 47 and 48. Concrete 45 is poured through and around block 46 to fix it in place to form footing 45. In order to provide a level floor, part of blocks 47 and 48 are removed and the floor slab of concrete 49 is inserted.

In FIG. 11, the height tolerances are more clearly shown of the 3 superposed blocks of FIG. 10. From the center line of the balls 3, irregardless of the block heights which vary from $7\frac{5}{8}$ inches to $7\frac{3}{4}$ inches, the distance from center line to center line of the balls is 7.875 inches (20 cms.)±0.002 inches in tolerance. It is possible to obtain such close tolerances only because of the precise machining of the openings during drilling.

In FIG. 12, there is shown a means to connect one type of a door frame to an end block. Corresponding grooves 51 are formed in an end block 35 so that steel plate 37 can be used as a connector. This connection when used with caulking 54 between the 2 members will secure the door frame 50 without the need to use any other supports.

To sum up, the novel leveling building system when constructing a wall with unskilled labor including the laying of a level footing is the first system that makes the ball connection system between superposed blocks commercially viable. This system solves the problem of variations in height of ordinarily manufactured building blocks as well as the variations in the perpendicularity of the aligned blocks in the wall. An added novelty includes the use of a steel plate to connect a door frame to a standard end block.

It is not intended to limit this invention to the details defined in the claims which follow since various modifications and structural changes may be made without departing in any way from the spirit of the present invention. The gist of this invention can enable others to apply current knowledge and adapt it for various applications without omitting features that, from the standpoint of the prior art, fairly constitute essential characteristics of the generic or the specific aspects of this invention.

What is claimed is:

1. A wall comprising superposed rows of longitudinally aligned building blocks, said blocks having approximately parallel front and back faces connected by a plurality of transverse webs defining chambers between said webs, the top and bottom of said front and back faces being approximately parallel and providing longitudinally extending tops and bottoms for said blocks, said tops and bottoms being formed to include uniformly spaced apart ball-receiving depressions positioned so that the depressions in the tops of each block mate with the depressions in the bottoms of the block above it, balls fitted into the space defined by mating depressions, said balls being slightly larger than said mating depressions to space the blocks, the depressions in the tops of each block being machined to a specific depth in relation to the height of the block so that the interconnection of said blocks by said balls provides horizontal alignment for each ball-supported block, the upper face of said webs being formed with longitudinally aligned V-shaped grooves which are accurately positiond at a uniform distance from the front faces of said blocks, and elongated straight bars of circular cross-section fitted in said grooves and extending longitudinally and horizontally from one block to the next to provide longitudinal alignment of the blocks in each row.

2. A wall as recited in claim 1 in which said balls are metal balls.

3. A wall as recited in claim 2 in which said balls are hollow.

4. A wall as recited in claim 1 in which the lengthwise distance between adjoining balls equals $\frac{1}{2}$ the modular length of the blocks.

5. A wall as recited in claim 1 in which the crosswise distance between the lines of adjoining balls is 1.180 inches smaller than the width of the blocks.

6. A wall as recited in claim 1 in which some of said chambers are filled with reinforced concrete.

7. A wall as recited in claim 1 in which the front face of said wall has a cementitious composition coated thereon.

8. A wall as recited in claim 1 in which said building blocks are conventional concrete building blocks having a size of 20 cm. by 40 cm. and the balls are metal balls spaced 20 cm. apart both in the longitudinal horizontal position and in the vertical position.

9. A wall as recited in claim 1 in which said depressions in said blocks are drilled to a maximum tolerance of 0.002 inch both in depth and in the spacing therebetween.

* * * * *